United States Patent [19]

Yoshihisa et al.

[11] Patent Number: 4,779,425

[45] Date of Patent: Oct. 25, 1988

[54] REFRIGERATING APPARATUS

[75] Inventors: Sasaki Yoshihisa, Isesaki; Sunaga, Mamoru, Ota, both of Japan

[73] Assignee: Sanden Corporation, Gunma, Japan

[21] Appl. No.: 61,271

[22] Filed: Jun. 12, 1987

[30] Foreign Application Priority Data

Jun. 14, 1986 [JP] Japan ..... 61-90015[U]
Jun. 14, 1986 [JP] Japan ..... 61-90016[U]

[51] Int. Cl.[4] ..... F25B 5/00
[52] U.S. Cl. ..... 62/199; 62/278
[58] Field of Search ..... 62/197, 199, 200, 278, 62/277, 81

[56] References Cited

U.S. PATENT DOCUMENTS 4,691,527 9/1987 Ikeda ..... 62/199 X

FOREIGN PATENT DOCUMENTS 0034157 3/1979 Japan ..... 62/200
0136458 10/1979 Japan ..... 62/197
1314341 4/1973 United Kingdom ..... 62/199

*Primary Examiner*—Harry B. Tanner

*Attorney, Agent, or Firm*—Banner, Birch, McKie & Beckett

[57] ABSTRACT

A refrigerating apparatus for individually refrigerating a plurality of chambers by a single compressor is disclosed. The refrigerating apparatus includes a plurality of evaporators which are disposed one in each of the respective chambers, and are coupled with each other in parallel. An electromagnetic valve is coupled to each evaporator in series to control the flow of refrigerant, and an expansion valve such as a capillary tube also is coupled to each evaporator in series, to thereby form a plurality of electromagnetic valve-expansion valve-evaporator combinations. An additional heat exchanger is disposed in the refrigerating circuit in parallel with the parallel electromagnetic valve-expansion valve-evaporator combinations through a valve device. The valve device allows adjustment of the flow of refrigerant to the evaporators and the additional heat exchanger to maintain the chambers at their desired temperature without varying the capacity of the compressor. The additional heat exchanger may be defrosted during operation of the refrigerating circuit by serving as a condenser.

5 Claims, 2 Drawing Sheets

REFRIGERATING APPARATUS

TECHNICAL FIELD

The present invention relates to a refrigerating apparatus. More particularly, the present invention relates to a refrigerating circuit for use in a refrigerating apparatus having a single compressor and a plurality of evaporating devices for individually refrigerating a plurality of chambers.

BACKGROUND OF THE INVENTION

It is well known to provide a refrigerating apparatus with a plurality of evaporators for individually refrigerating a plurality of refrigerating chambers. The temperature in each refrigerating chamber is controlled by operation of electromagnetic valves, each of which is serially connected with a respective evaporator to control the flow of refrigerant through each evaporator.

FIG. 1 shows a known refrigerating apparatus. The refrigerating apparatus includes compressor 1, oil separator 2, condenser 3, a plurality of evaporators 6, a plurality of electromagnetic valves 4, a plurality of capillary tubes 5, and accumulator 7. These elements are coupled in series to form a closed refrigerating circuit. That is, each respective electromagnetic valve 4, capillary tube 5, and evaporator 6 are connected in series, and the resulting electromagnetic valve-capillary tube-evaporator combinations are coupled in parallel. These parallel combinations are connected in series with compressor 1 and condenser 3 through distributor 8. Electromagnetic valves 4 control refrigerant flow and capillary tubes 5 function as expansion valves or decompression devices. Thus, if the operation of each electromagnetic valve 4 is controlled by the signal from a respective temperature detecting device disposed on each refrigerating chamber, the temperature in each refrigerating chamber can be maintained at a predetermined level.

In the above refrigerating circuit, the capacity of the compressor should be chosen to supply refrigerant to all evaporators to properly operate each evaporator. The temperature in each chamber is individually controlled by the operation of its electromagnetic valve, and each chamber is normally maintained at a different temperature than the others. Therefore, sometimes many or most of the electromagnetic valves are closed at the same time. During these instances, the capacity of the compressor exceeds the required capacity of the refrigerating apparatus. If the capacity of the compressor exceeds the required capacity for the refrigerating apparatus, the pressure in the suction port side of the compressor is reduced and vacuum conditions are reached. However, when the compressor is driven under vacuum conditions, atmospheric air can easily enter into the refrigerating circuit. The atmospheric air contains moisture, this moisture freezes on the capillary tube, and the flow of refrigerant is obstructed.

To resolve these disadvantages, a pressure switch is disposed on the suction port side of the compressor. The operation of the compressor ceases when the suction pressure falls below the predetermined pressure which is detected by the pressure switch. However, if the compressor is provided with a pressure switch, the compressor is intermittently driven by the temperature change in the chambers, as well as by the suction pressure change. This decreases the durability of the compressor, and the temperature in the chambers is not stabilized.

SUMMARY OF THE INVENTION

It is a primary object of the present invention to provide an improved refrigerating apparatus which varies the flow of refrigerant according to changes in the actual refrigerating load.

It is another object of the present invention to provide a refrigerating apparatus which varies refrigerant flow without intermittently driving the compressor and which therefore improves the durability of the compressor while stabilizing the temperature in refrigerating chambers.

It is another object of the present invention to provide a refrigerating apparatus which continues the refrigerating operation while defrosting one of the heat exchangers.

A refrigerating apparatus in accordance with this invention includes a compressor, a condenser, a plurality of valve devices, a plurality of expansion devices, and a plurality of evaporators which are disposed individually in the refrigerating chambers. These components are coupled to each other in series to form a closed refrigerating circuit in which the refrigerant can be circulated selectively to each evaporator for individually refrigerating the chambers. Each respective valve device, expansion device, and evaporator are coupled in series to form a combination, and the plurality of combinations are connected in parallel. The parallel combinations are disposed in series with the other components of the refrigerating circuit. The temperature in each chamber is controlled by the operation of its respective valve device.

An additional heat exchanger is coupled to the refrigerant circuit in parallel with the parallel valve device-expansion device-evaporator combinations to serve as an artificial refrigerating load when the valve devices shut off evaporators to maintain constant temperatures in the chambers. The refrigerant detoured from the evaporators is routed through the additional heat exchanger to avoid intermittent operation of the compressor. Two four-way valves allow the additional heat exchanger to operate as a condenser and to permit the condenser to operate as an artificial refrigerating load when the additional heat exchanger is defrosted during operation of the refrigerating circuit.

Various additional advantages and features of novelty which characterize the invention are further pointed out in the claims that follow. However, for a better understanding of the invention and its advantages, referance should be made to the accompanying drawing and descriptive matter which illustrate and describe preferred embodiments of the invention.

DETAILED DESCRIPTION OF PREFERRED EMBODIMENTS

Figure 1:
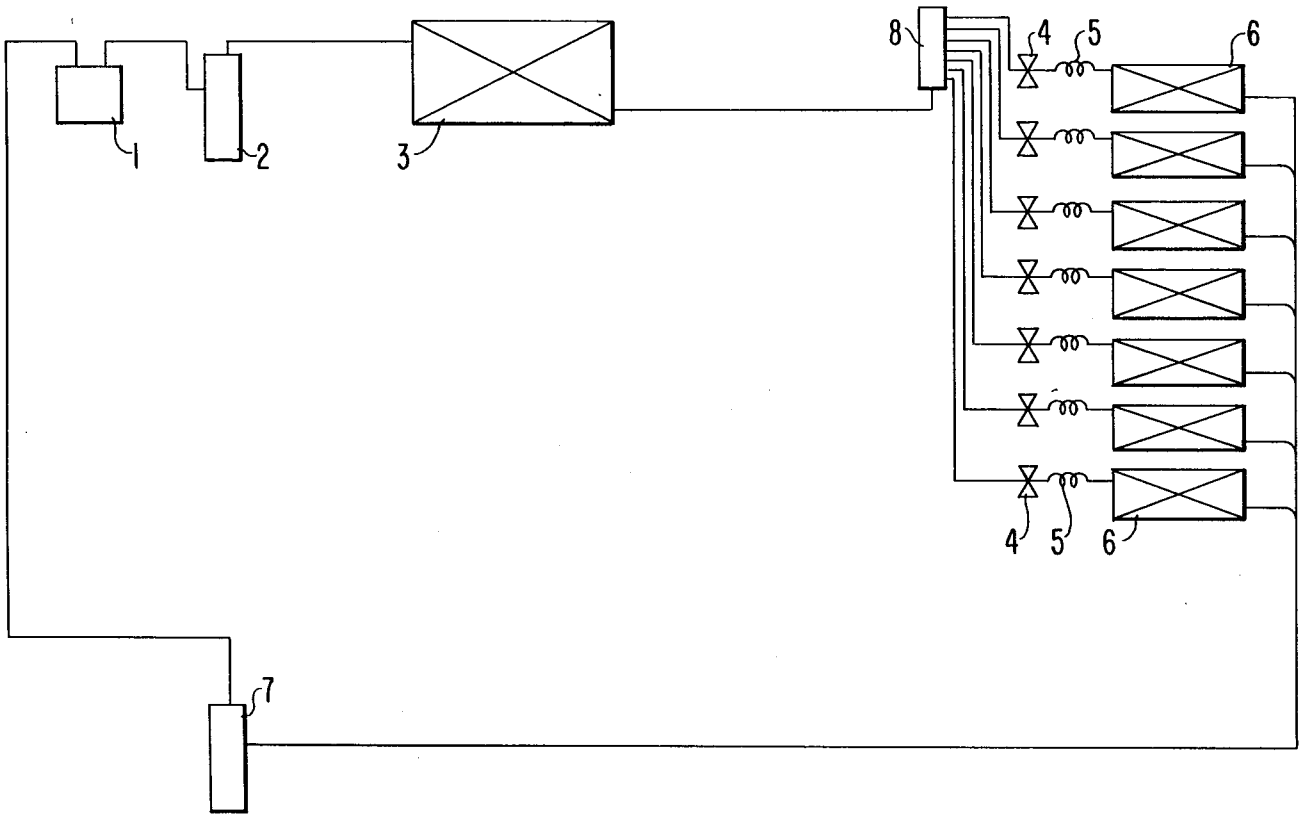
FIG. 1 is a schematic view of a refrigerating circuit of a conventional prior art refrigerating apparatus.
Figure 2:
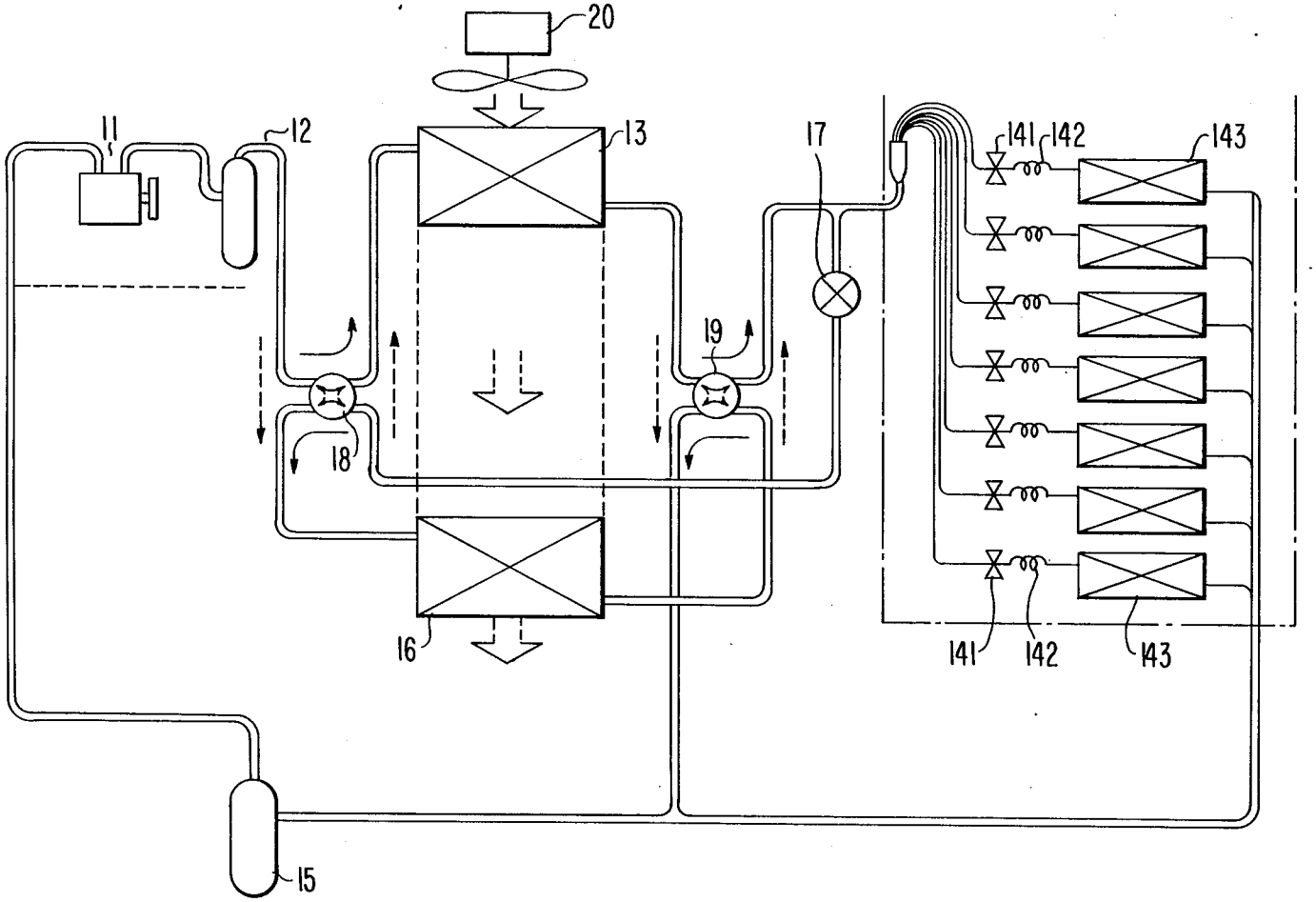
FIG. 2 is a schematic view of a refrigerating circuit in accordance with one embodiment of this invention.

Referring to FIG. 2, a refrigerating apparatus in accordance with one embodiment of this invention includes compressor 11, oil separator 12, condenser 13, a plurality of parallel electromagnetic valves 141, a plurality of parallel decompression devices such as capillary tubes 142, a plurality of parallel evaporators 143, and accumulator 15. These components are coupled in series to form a refrigerating circuit. One electromagnetic valve 141, one capillary tube 142, and one evaporator 143 are coupled in series, respectively, and this combination is connected in parallel with other electromagnetic valve-capillary tube-evaporator combinations. The parallel combinations are disposed in series with the other elements of the refrigerating circuit.

Additional heat exchanger 16, which functions as an artificial load, is disposed in the refrigerating circuit in parallel with the parallel electromagnetic valve-capillary tube-evaporator combinations. The flow of refrigerant into additional heat exchanger 16 is controlled by serially coupled constant pressure expansion valve 17. Furthermore, the inlet side line of additional heat exchanger 16 is connected with the inlet side line of condenser 13 through first four-way valve 18. The outlet side line of additional heat exchanger 16 is connected with the outlet side line of condenser 13 through second four-way valve 19 to switch the functions of condenser 13 and second heat exchanger 16.

In this refrigerating circuit, evaporators 143 are disposed in respective, independently formed refrigerating chambers. Each electromagnetic valve 141 individually controls the refrigerating operation in each chamber by detecting a signal from a temperature detecting device, such as a thermostat or thermo-switch, disposed on each chamber. Therefore, the temperature in each refrigerating chamber is controlled by operation of the electromagnetic valve.

When first and second four way valves 18, 19 are positioned to operate the circuit as a conventional refrigerant circuit, i.e., compressor 11, condenser 13, the parallel combination of electromagnetic valve 141, capillary tube 142, and evaporator 143, and accumulator 15 are coupled in series with each other, and additional heat exchanger 16 is parallelly coupled with the parallel combination, compressed refrigerant is condensed in condenser 13 and flows into evaporators 143 (this refrigerant flow is indicated by the solid line arrows in FIG. 2). After passing through capillary tube 142, the refrigerant is expanded within evaporator 143 and heated by the atmospheric air which is cooled. Therefore, each chamber in which evaporator 143 is disposed is refrigerated.

If the capacity of compressor 11 exceeds the actual refrigerating load, such as when several electromagnetic valves 141 are closed to control the temperature in their respective chambers, constant pressure expansion valve 17 opens due to a pressure change at its inlet port to direct the otherwise unused refrigerant into additional heat exchanger 16. Additional heat exchanger 16 functions as an artificial refrigerating load for the refrigerating apparatus. Conversely, if a large refrigerating load is required, the amount of refrigerant flowing into additional heat exchanger 16 is reduced and the amount of refrigerant flowing into the parallel combination is increased. Therefore, compressor 11 continuously operates under the appropriate refrigerating load regardless of the number of operating evaporators.

As additional heat exchanger 16 operates, frost on additional heat exchanger 16 increases and its heat exchanging efficiency decreases. Therefore, to defrost additional heat exchanger 16, first and second four-way valves 18, 19 change the flow path of the refrigerant. Thus, the compressed refrigerant is initially introduced into additional heat exchanger 16 from oil separator 12, and then flows into evaporators 143 (this flow of refrigerant is indicated by the dotted line arrows in FIG. 2). Refrigerant flow into condenser 13 is through constant pressure expansion valve 17. Additional heat exchanger 16 functions as a condenser, and condenser 13 functions as an artificial refrigerating load for the refrigerating apparatus. Additional heat exchanger 16 is defrosted by high pressure and high temperature compressed refrigerant. Refrigeration in each chamber continues while defrosting additional heat exchanger 16.

Furthermore, as shown in FIG. 2, forced air is supplied to condenser 13 by blower or fan 20 to improve indirect heat exchange between the refrigerant and ventilated air. The air passed through condenser 13 becomes warmer. Therefore, if additional heat exchanger 16 is positioned on the side of condenser 13 opposite fan 20, additional heat exchanger 16 may be defrosted by the hot air blown through condenser 13, and four-way valves 18, 19 need not be used.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be affected therein by one skilled in the art without departing from the scope or spirit of the invention.

We claim:

1. In a refrigerating apparatus for individually refrigerating a plurality of chambers having a closed refrigerating circuit including a serial combination of a compressor, a condensor, a plurality of parallel first valve devices, and a plurality of parallel evaporators adapted to be disposed one in each of said chambers, one of said plurality of valve devices being coupled with a respective said evaporator to control the operation of said evaporator, one said first valve device and one said evaporator being coupled in series, the combination of said first valve device and said evaporator being connected in parallel with other said first valve device-evaporator combinations, and said parallel combinations being connected in series with the other elements of said closed refrigerating circuit, the improvement comprising:

an additional heat exchanger coupled with said refrigerating circuit in parallel with said first valve device evaporator-combinations, and connected in parallel with said condensor through a pair of four-way valve devices, said additional heat exchanger operating as an artificial refrigerating load when at least one of said evaporators is not operating due to the closure of respective said first valve devices and said additional heat exchanger serving as a condensor and said condensor serving as an artificial refrigerating load when said four-way valve devices are positioned to defrost said additional heat exchanger; and a second valve device disposed on the inlet side of said additional heating exchanger to control the flow of refrigerant to said additional heat exchanger.

2. The refrigerating apparatus as set forth in claim 1 wherein a fan is disposed on one side of said condenser and said additional heat exchanger is located on the side of said condenser opposite said fan, said additional heat exchanger being defrosted due to hot air blown by said fan through said condenser.

3. The refrigerating apparatus as set forth in claim 1 wherein said second valve device comprises a constant pressure expansion valve.

4. The refrigerating apparatus as set forth in claim 1 wherein said first valve devices comprise electromagnetic valves.

5. The refrigerating apparatus as set forth in claim 1 further comprising a plurality of capillary tubes, one of said capillary tubes being disposed in series with a respective said first valve device-evaporator combination, each said capillary tube being disposed between a respective said first valve device and a respective said evaporator.

* * * * *